US005984144A

United States Patent [19]

Wyatt

[11] Patent Number: 5,984,144

[45] Date of Patent: Nov. 16, 1999

[54] BEVERAGE DISPENSING APPARATUS

[75] Inventor: Gary David Wyatt, Worcester, United Kingdom

[73] Assignee: Whitlenge Drink Equipment Ltd, United Kingdom

[21] Appl. No.: 09/036,841

[22] Filed: Mar. 9, 1998

[30] Foreign Application Priority Data

Mar. 18, 1997 [GB] United Kingdom ..... 9705572

[51] Int. Cl.[6] ..... B67D 5/62

[52] U.S. Cl. ..... 222/146.6; 62/59

[58] Field of Search ..... 222/146.6; 62/59, 62/392

[56] References Cited

U.S. PATENT DOCUMENTS

| | | | |
|---|---|---|---|
| 4,497,179 | 2/1985 | Iwans | 62/59 |
| 4,515,505 | 5/1985 | Mueller et al. | 222/146.6 |
| 5,035,121 | 7/1991 | Cook | 222/146.6 |
| 5,191,773 | 3/1993 | Cassell | 62/373 |
| 5,537,838 | 7/1996 | Mills et al. | 222/146.6 |
| 5,617,736 | 4/1997 | Ito et al. | 62/393 |
| 5,732,856 | 3/1998 | Fry | 222/146.6 |
| 5,845,506 | 12/1998 | Jobmann | 222/146.6 |
| 5,873,259 | 2/1999 | Spillman | 222/146.6 |

FOREIGN PATENT DOCUMENTS

| | | |
|---|---|---|
| 2 167 845 | 6/1986 | United Kingdom . |
| 2 208 536 | 4/1989 | United Kingdom . |
| 2208536 | 4/1989 | United Kingdom . |
| 2227085 | 7/1990 | United Kingdom . |
| 2228310 | 8/1990 | United Kingdom . |
| 2247848 | 3/1992 | United Kingdom . |

*Primary Examiner*—Joseph A. Kaufman
*Attorney, Agent, or Firm*—R. Neil Sudol; Henry D. Coleman

[57] ABSTRACT

A beverage dispenser comprises a cooling device comprising a cooling chamber (6) filled with a cooling liquid, such as water. Located within the chamber (6) is a refrigeration component (8). Extending through the chamber is a conduit (10), by which beverage is fed from a supply towards a dispensing head (30), the conduit including to a heat exchanging coil (12) within the chamber. Located in the chamber at a position so as to be totally immersed by cooling liquid is a pump unit comprising a motor **(16*a*) and an impeller (16*b*), the motor also driving an agitator (18) to cause liquid within the chamber (6) to be circulated to the refrigeration component (8) and the cooling coils (12)**.

3 Claims, 1 Drawing Sheet

BEVERAGE DISPENSING APPARATUS

BACKGROUND OF THE INVENTION

This invention is concerned with improvements relating to cooling devices, particularly but not exclusively, to cooling devices for the cooling of beverages.

A cooling device of the kind commonly utilized in the cooling of beverages in a beverage dispenser, referred to hereinafter as being of the kind specified, comprises a chamber containing a cooling liquid, refrigeration means to cool the cooling liquid and a heat exchanger immersed in the cooling liquid through which beverage to be cooled is fed.

Conventionally such a cooling device utilises an agitation means to cause the cooling liquid to circulate around the chamber, to pass into contact with the refrigeration means, and to pass into contact with the heater exchanger, to ensure a high level of heat exchange between the heat exchanger and the refrigeration means. Conventionally such an agitation means comprises an agitation member (such as a fan blade) located in the cooling chamber, and which is driven by a motor exteriorally of the cooling chamber. This requires the use of sealing means to seal the moveable drive shaft as it passes through the wall of the cooling chamber, reducing the thermal insulation of the interior of the cooling chamber, and, depending upon the design, risking the leakage of cooling fluid from the chamber.

Additionally, such a cooling device comprises a pump for the delivery of cooling liquid to other areas in which a cooling function is required, such as in the dispensing of beverages, a conduit extending towards a dispensing head of the beverage dispenser, and/or to the head itself. Conventionally the pump comprises a motor located exteriorally of the cooling chamber, the impeller for the pump being driven by the motor by means of a drive shaft. This construction provides a requirement for high quality seals to prevent any ingress of cooling liquid from the impeller and/or into the motor.

It is also desirable to reduce the size of the beverage dispenser and/or the cooling device per se, and it is one of the various objects of this invention to provide a cooling device for a beverage dispenser which is compact in its construction and efficient in its operation.

SUMMARY OF THE INVENTION

According to this invention there is provided a cooling device for use in a beverage dispenser comprising:

(i) a chamber containing a cooling liquid, (ii) refrigeration means to cool the cooling liquid, (iii) a heat exchanger immersed in the cooling liquid, (iv) a cooling circuit comprising a conduit extending from the chamber and a conduit returning to the chamber and, (v) a motor within the chamber and immersed in the cooling liquid in the chamber, the motor providing (i) drive means for agitation means for circulating cooling liquid around the chamber, and (ii) drive means for pumping means for pumping cooling liquid around said circuit.

According to this invention there is also provided a beverage dispensing apparatus comprising a head through which beverage is dispensed, a supply conduit connecting the dispensing head with a supply of beverage, and a cooling device to cool beverage flowing through the supply conduit towards the head, the cooling device being as set out in the last preceding paragraph.

According to this invention there is also provided a beverage dispensing apparatus comprising a head through which beverage may be dispensed, a supply conduit which may connect the dispensing head with a supply of beverage, and a cooling device to cool beverage flowing through the supply conduit towards the head, the cooling device comprising a cooling chamber containing a cooling liquid, refrigeration means to cool the cooling liquid within the chamber, a heat exchanger immersed in the cooling liquid, the heat exchanger forming part of the supply conduit, and a pump for the delivery of cooling liquid from the chamber to the head of the dispensing device, the pump comprising a motor and impeller means for the delivery of cooling liquid from the chamber to the head and back to the chamber, characterised in that the motor is so located in the chamber as to be wholly immersed in the cooling liquid within the chamber.

DETAILED DESCRIPTION OF THE PREFERRED EMBODIMENTS

Figure 1:
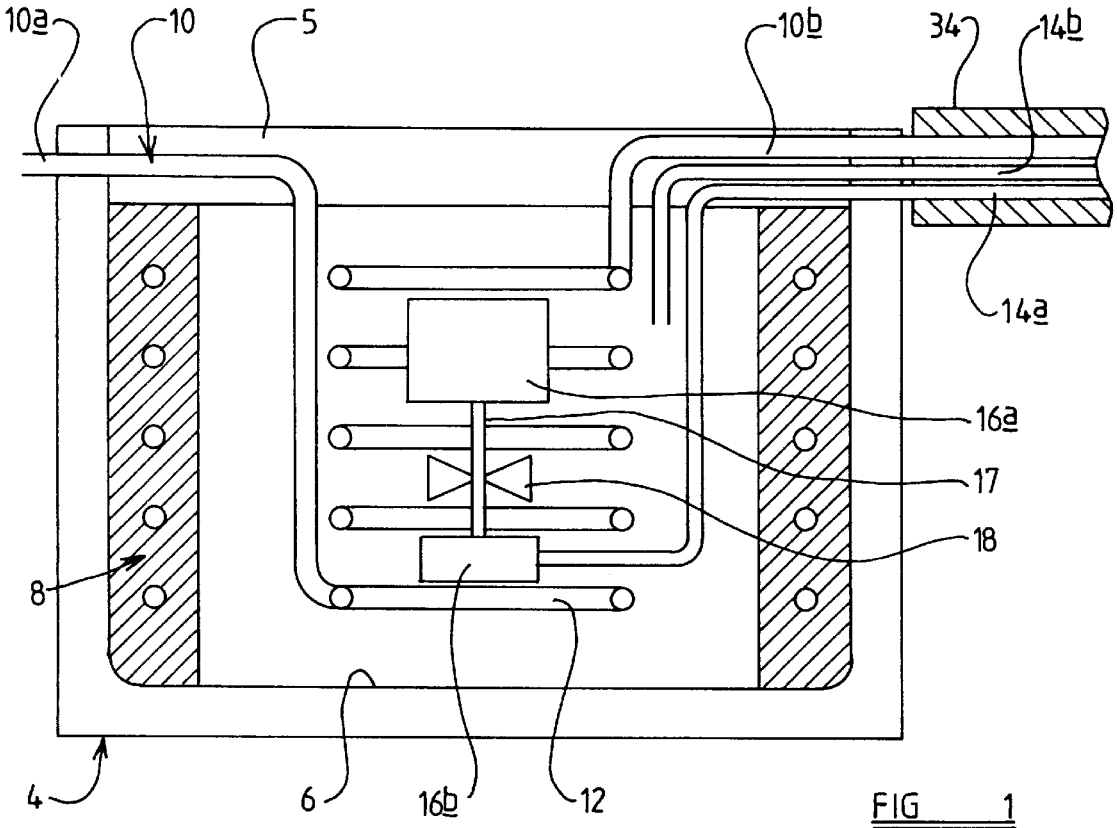
FIG. 1 is a schematic representation of a first part of a dispensing apparatus which is a preferred embodiment of this invention, having been selected for the purposes of illustrating the invention by way of example, showing in particular a cooling device thereof.
Figure 2:
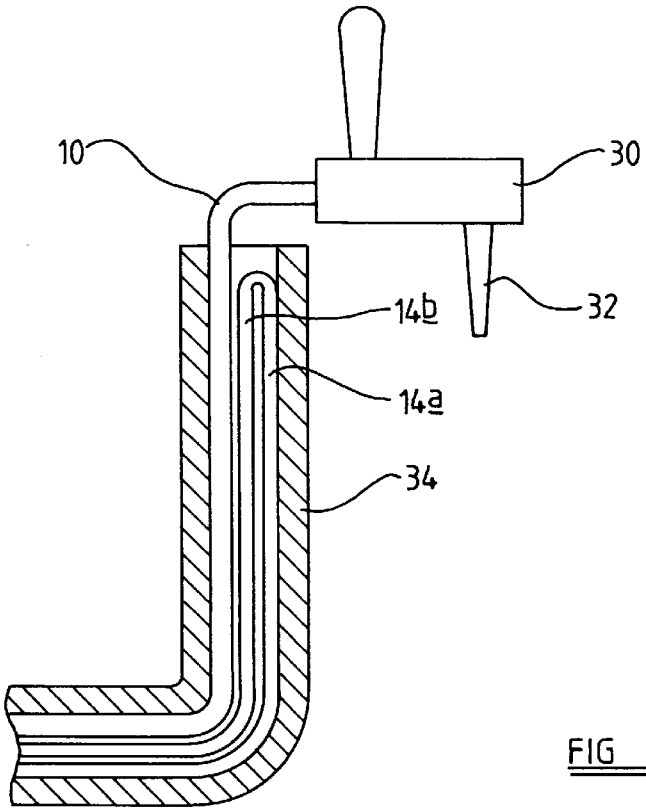
FIG. 2 is a schematic representation of a second part of the dispensing apparatus, showing in particular a dispensing head thereof.

The cooling device shown in FIG. 1 is designed for use as part of a beverage dispenser in which context the cooling device will be described hereinafter. It is, however, to be appreciated that the cooling device may be utilized in the cooling of other fluids, where similar or analogous problems arise.

The cooling device which is the preferred embodiment of this invention comprises a housing 4 defining a cooling chamber 6 which in use is filled with a cooling medium, such as water, the chamber 6 being closed by a cover 5 for the housing.

Located in the chamber 6 is a refrigeration means 8, conveniently, generally cylindrical in form, having an ice-bank through which refrigeration fluid is fed.

The apparatus also comprises a dispensing head 30, to which cooled beverage is fed, to be delivered to a receptacle placed beneath an outlet 32 of the head. Thus the apparatus comprises a supply conduit 10, comprising a first section 10*a* extending from a supply of the beverage (not shown), a second section 12 in the form of a cooling coil located in the cooling chamber, and a third section 10*b* extending from the cooling coil to the head 30 of the apparatus.

Located in the chamber in a position so as to be totally immersed by cooling liquid, is a pump unit comprising an electric motor 16(*a*) and an impeller 16(*b*), the pump being of the type commonly used in aquaria or garden ponds. The apparatus comprises a cooling circuit 14 extending from the cooling chamber to the vicinity of the dispensing head, said cooling circuit 14 comprising exit and return conduits 14*a*, 14*b*.

The pump is operative to feed cooling liquid from the chamber 6 by exit conduit 14(*a*) to the dispensing head, to retain beverage within the supply conduit 10*b* also cooled, the cooling liquid fed to the dispensing head being returned by conduit 14(*b*) to the chamber 6.

The conduits 14*a* and 14*b* extend between the cooling chamber and the dispensing head conveniently in close proximity to the section 10*b* of the supply conduit, to retain beverage therein cool. If desired however, the conduits 14*a* and 14*b* may extend into the head 30, to maintain liquid retained in the head also at a low temperature.

Advantageously, as shown in the drawings, the conduits 14*a*, 14*b* and 10*b* extend through an insulated sleeve 34, to reduce transmission of heat thereto.

The impeller 16(*b*) is driven by the motor 16(*a*) by a drive shaft 17, on which there is mounted an agitator 18, conveniently in the form of agitator blades. Thus, whilst the electric motor 16(*a*) operates to circulate cooling liquid through the conduit 14(*a*), the dispensing head and conduit 14(*b*), the agitator 18 simultaneously serves to cause liquid within the chamber 6 to be circulated to the refrigeration means 8 and the cooling coils 12.

In this manner both pumping and agitation functions may be carried out conveniently and expeditiously, and by the use of a pump which is wholly submerged within the cooling liquid, problems of bearings and seals, which are conventionally encountered in cooling devices of the kind with which the present invention is concerned, may be significantly reduced.

Additionally by moving the pump to a position within the cooling liquid, conveniently within the coils at the heat exchange unit 12, the unit may be made smaller, and/or greater use may be made of the space available.

By the use of the invention above mentioned, a beverage dispenser comprising cooling device may be manufactured which is significantly more efficient than conventional apparatus, having the further advantages that it may be smaller than the conventional apparatus, and in practice has been found to operate with a greater reliability.

I claim:

1. A cooling device for use in a beverage dispenser comprising:

(i) a chamber containing a cooling liquid, (ii) refrigeration means to cool the cooling liquid, (iii) a heat exchanger immersed in the cooling liquid, (iv) a cooling circuit comprising a conduit extending from the chamber and a conduit returning to the chamber and, (v) a motor within the chamber and immersed in the cooling liquid in the chamber, the motor providing (i) drive means for agitation means for circulating cooling liquid around the chamber, and (ii) drive means for pumping means for pumping cooling liquid around said circuit.

2. A beverage dispensing apparatus comprising a head through which beverage is dispensed, a supply conduit connecting the dispensing head with a supply of beverage, and a cooling device to cool beverage flowing through the supply conduit towards the head, the cooling device including:

(i) a chamber for containing a cooling liquid;

(ii) a refrigeration component to cool the cooling liquid;

(iii) a heat exchanger immersed in the cooling liquid;

(iv) a cooling circuit comprising a conduit extending from the chamber and a conduit returning to the chamber; and (v) a motor within the chamber and immersed in the cooled liquid in the chamber, the motor providing (a) drive means for agitation means for circulating cooling liquid around the chamber, and (b) drive means for pumping means for pumping cooling liquid around said circuit.

3. In a beverage dispensing apparatus comprising a beverage dispensing head, a supply conduit connecting the dispensing head with a supply of beverage, and a cooling device to cool beverage flowing through the supply conduit towards the head, the cooling device comprising a cooling chamber containing a cooling liquid, refrigeration means to cool the cooling liquid within the chamber, a heat exchanger immersed in the cooling liquid, the heat exchanger forming part of the supply conduit, a pump for the delivery of cooling liquid from the chamber to the dispensing head, and an agitation means for causing cooling liquid to be circulated around the cooling chamber, the improvement wherein a drive means both for the pump and for the agitation means is provided by a motor located in the chamber and immersed in the cooling liquid within the chamber.

* * * * *